US006203276B1

(12) United States Patent
Lasko et al.

(10) Patent No.: US 6,203,276 B1
(45) Date of Patent: Mar. 20, 2001

(54) ILLUMINATED CONTROLS FOR AIR MOVING PRODUCTS

(75) Inventors: William E. Lasko; Michael Cichetti; Leo Gonzales, all of West Chester, PA (US)

(73) Assignee: Lasko Holdings, Inc, West Chester, PA (US)

( * ) Notice: Subject to any disclaimer, the term of this patent is extended or adjusted under 35 U.S.C. 154(b) by 0 days.

(21) Appl. No.: 09/307,844

(22) Filed: May 10, 1999

(51) Int. Cl.[7] ..... F04D 29/00
(52) U.S. Cl. ..... 416/61; 416/5
(58) Field of Search ..... 416/61, 5, 44, 416/31, 244, 247; 417/14, 63, 423.1

(56) References Cited

U.S. PATENT DOCUMENTS 4,289,195 * 9/1981 Bellot et al. ..... 165/12
5,304,112 * 4/1994 Mrklas et al. ..... 600/27
5,916,288 * 6/1999 Hartman ..... 701/36

FOREIGN PATENT DOCUMENTS 63-12899 * 1/1988 (JP) ..... 416/5

* cited by examiner

*Primary Examiner*—Edward K. Look
*Assistant Examiner*—James M. McAleenan
(74) *Attorney, Agent, or Firm*—Zachary T. Wobensmith, III

(57) ABSTRACT

Illuminated controls for use with air moving products such as fans and humidifiers wherein the controls for motor speed, temperature, or humidity are illuminated by an electroluminescent panel to show the location and settings.

5 Claims, 2 Drawing Sheets

ILLUMINATED CONTROLS FOR AIR MOVING PRODUCTS

BACKGROUND OF THE INVENTION

1. Field of the Invention

This invention relates to controls for air moving products such as fans or humidifiers, of the type that are illuminated to show the general control location, as well as the control settings for the speed,or thermostat for fans, or humidistat settings for humidifiers.

2. Description of the Prior Art

Air moving products such as fans and humidifiers are widely used in many locations, and are often used in bedrooms. It is desirable to be able at any time to change the temperature, or degree of humidity, or the speed of the motor which circulates the air in the room.

It is desirable to be able to view the settings on the fan or humidifier at night without turning on a light, however while illumination of the thermostat, or humidistat, or switch control must be easily visible it should be unobtrusive.

In the prior art it is known to use LED'S or minature incadescent lights or neon bulbs to illustrate the status of the apparatus, such as on/off,the bulbs may not be located at the control, and are not useful to show the exact location and status of the control.

The illuminated controls of the invention show both the location and status of the control.

The illuminated controls of the invention do not suffer from prior art problems, and provide many positive advantages.

SUMMARY OF THE INVENTION

It has now been found that illuminated controls are available to control the speed,and temperature, or humidity as well as indicate the control location on an air moving product,such as a fan, or humidifier by using an electroluminescent panel to illuminate the control.

The principal object of the invention is to provide illumination of the control location for the thermostat, humidistat, or motor speed controls for air moving products, such as fans,or humidifiers, and to provide illuminated settings for these controls.

A further object of the invention is to provide controls of the character aforesaid that are usable with a wide variety of air circulating fans.

A further object of the invention is to provide controls of the character aforesaid that are usable with humidifiers.

A further object of the invention is to provide controls of the character aforesaid that are simple and inexpensive to construct, but sturdy, reliable, and long lasting in operation.

A further object of the invention is to provide controls of the character aforesaid that provide excellent visibility of the controls, but are unobtrusive to the user.

A further object of the invention is to provide controls of the character aforesaid, which are inexpensive to operate.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative, and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
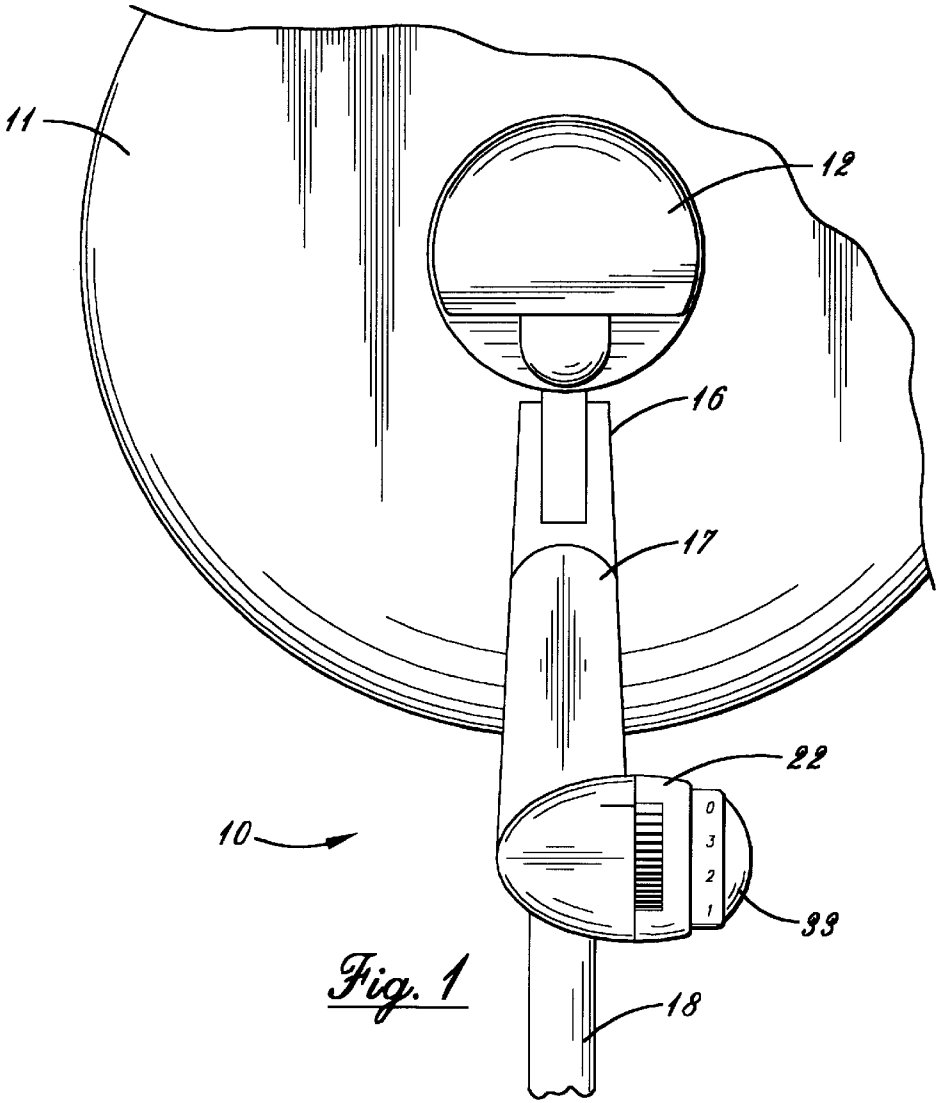
FIG. 1 is a front view of a pedestal fan incorporating the illuminated controls of the invention.
Figure 2:
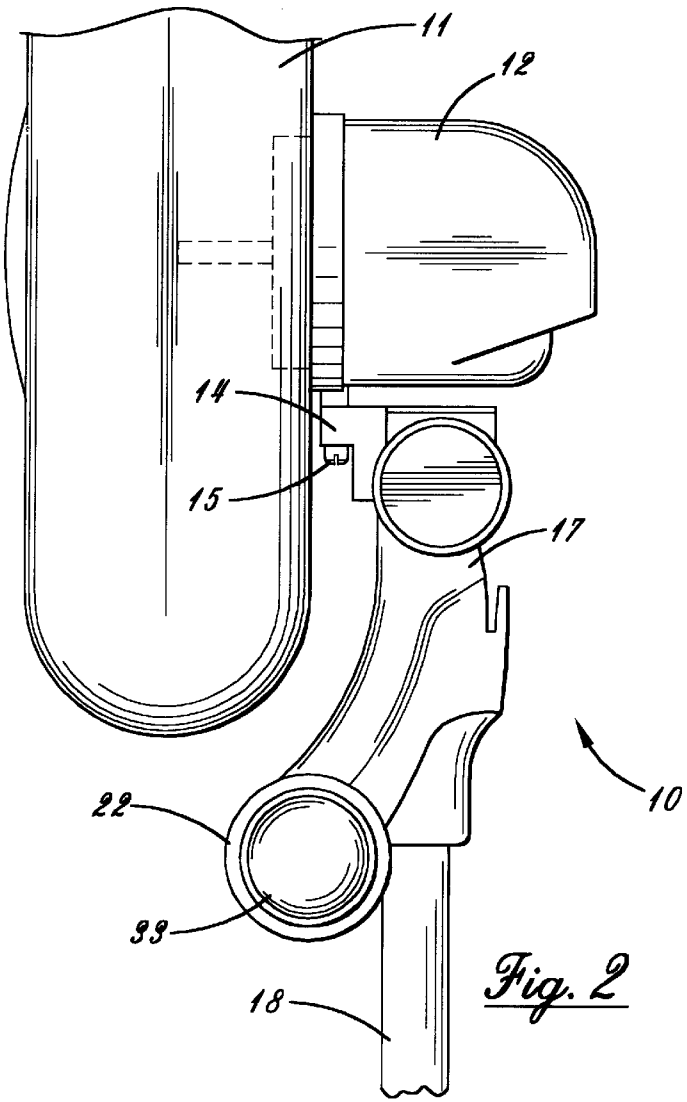
FIG. 2 is a side elevational view of the pedestal fan of FIG. 1.

Referring now more particularly to FIGS. 1 and 2 of the drawings, a portion of a pedestal fan 10 of well known type is therein illustrated. The fan 10 include a fan shroud 11, and a fan motor housing 12 to which the shroud 11 is attached.

The shroud 11 has a fan blade assembly therein (not shown) driven by a fan motor (not shown) located in the fan motor housing 12. The fan motor has a bracket 14 attached thereto by bolts 15, which bracket 14 is connected to the forks 16 of a yoke 17 by a bolt (not shown).

The yoke 17 is connected to tubing 18, which extends to a base (not shown), which supports the fan 10.

Figure 3:
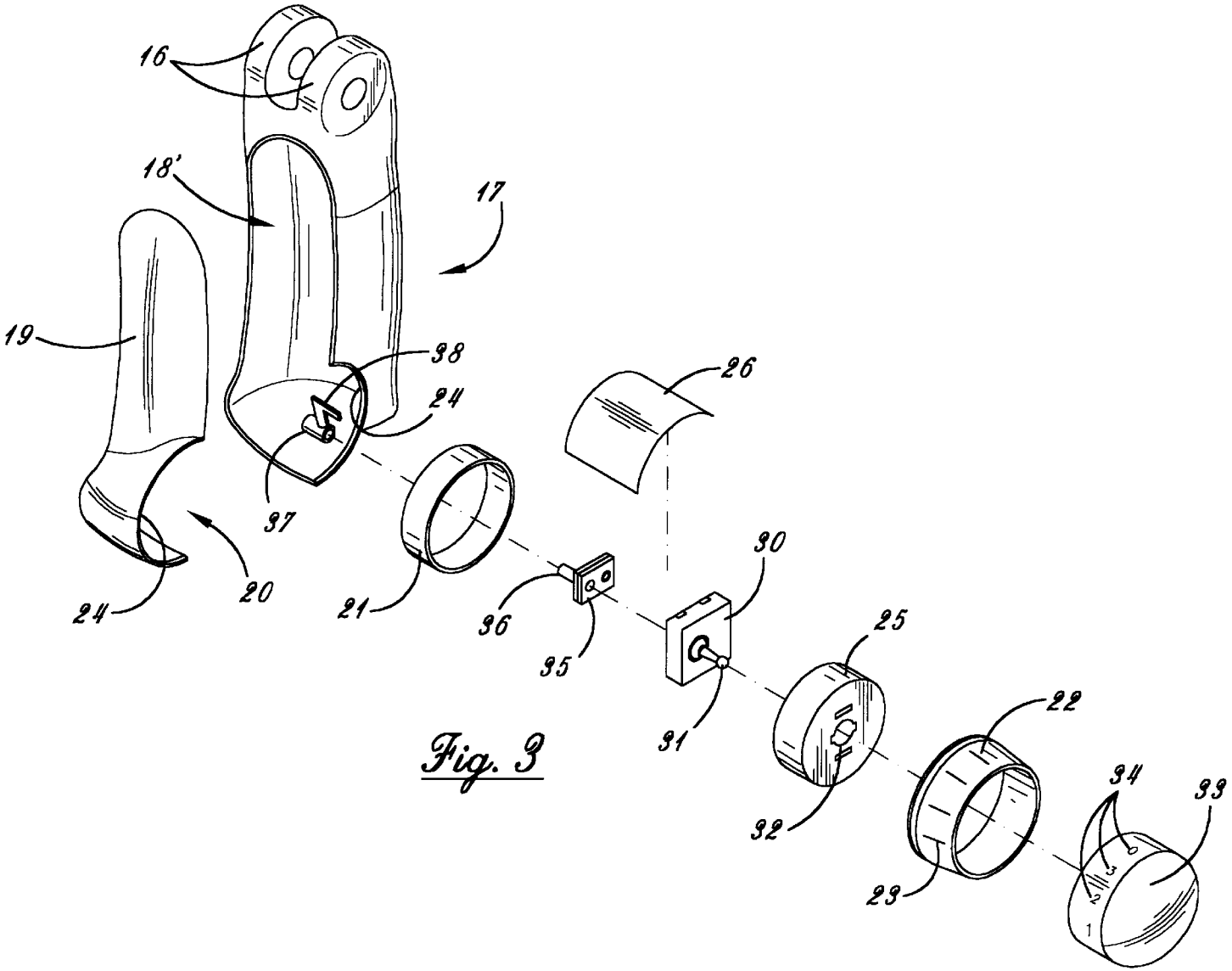
FIG. 3 is an exploded, perspective view of the illuminated controls of the invention.

Referring additionally to FIG. 3 the yoke 17 is illustrated in detail, and which is of two piece molded plastic construction, with a hollow tubing body 18, and a cover 19.

The yoke 17 has an opening 20, with a coupling 21 secured therein, which has a hollow, thermostat control knob 22 adjacent thereto, the knob 22 having a groove 23 engaged with a rim 24 of the cover 19, and the body 18, permitting rotation of the knob 22.

A cylindrical connector 25 is fixedly engaged to the coupling 21, and within and between it and the knob 22, is a panel 26 of electroluminescent film. The panel 26 is available from Jinxin Chemical Electronic Instruments Co.LTD of Shenzhen, China. The panel 26 includes a thin flexible lightweight substrate (not shown) of electroluminescent material, with a thin transparent protective cover (not shown) thereon of well known type. The panel 26 is connected to the electrical energy source (not shown) for the fan by wires (not shown).

The connector 25 has indicia thereon, which corresponds to the settings desired for the temperature range for an air moving product, or for a humidifier for the range of desired humidity.

The connector 25 is of hollow configuration, with a speed control switch 30 of well known type engaged therewith, with an input shaft 31 extending through an opening 32 in connector 25, which shaft has a speed control knob 33 engaged therewith, inside of thermostat knob 22, and which rotates input shaft 31 to cause the speed of the fan motor (not shown) to change.

The knob 33 is provided with indicia 34 thereon to indicate its position for the selected motor speeds.

A thermostat control 35 is provided, attached to switch 30, which has an input shaft 36, pointing towards the yoke 17.

A thermostat knob link 37 is provided, attached to input shaft 36, with an arm 38 extending forwardly and engaged in a groove (not shown) in thermostat knob 22 for rotation of link 37, and input shaft 36 of control switch 35, to activate the fan motor (not shown) as required. The mode of operation will now be pointed out.

The fan 10 electrical cord (not shown) is connected to a source of electrical energy. The knob 22 is rotated to display the desired temperature setting which rotates link 37 to vary the position of input shaft 36 and the on/off operation of the fan motor (not shown). The panel 26 provides illumination of knob 22, and also illumination of the speed control knob 33, which is rotated to determine the desired speed of the fan motor.

It should be noted that a humidistat (not shown) can be substituted for the thermostat for use in a humidifier embodiment.

It will thus be seen that structure has been provided with which the objects of the invention are obtained.

We claim:

1. In combination with controls for use with air moving products which control the fan motor speed, the temperature, or humidity of the air being moved by the product, the improvement which comprises an electroluminescent panel incorporated into said controls which does not require activation of the controls for its illumination, and wherein said panel illuminates said controls to indicate their location on the product and/or their settings.

2. Controls for use with air moving products as defined in claim 1 in which said air moving product is a portable fan.

3. Controls for use with air moving products as defined in claim 1 in which said air moving product is a humidifier.

4. Controls for use with air moving products as defined in claim 1 in which said product is a pedestal fan which includes an outer yoke having a hollow body, an opening in said yoke, a coupling in said yoke, a cylindrical connector open at one end and engaged with said coupling, said connector having indicia thereon to indicate temperature settings, a thermostat control knob rotatably engaged with said connector, said knob having a groove therein, said yoke opening having a rim engaged in said groove to retain said knob, an electroluminescent film panel between said connector and said knob, a fan speed switch in said connector having an input shaft extending through said connector, a speed control knob engaged with said fan speed switch shaft, said speed knob having indicia thereon to indicate the fan speed settings, a thermostat control engaged with said speed control switch and having an input shaft, a thermostat knob link engaged with said thermostat control shaft, and said link having an arm extending to and engaged with said thermostat control knob for rotation of said thermostat input shaft.

5. Controls for use with air moving products as defined in claim 1 in which said humidity control is a humidistat.

* * * * *